US007527035B2

(12) United States Patent
Schroeder

(10) Patent No.: US 7,527,035 B2
(45) Date of Patent: May 5, 2009

(54) FUEL SUPPLY SYSTEM, ESPECIALLY FOR AN INTERNAL COMBUSTION ENGINE

(75) Inventor: Bernd Schroeder, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 59 days.

(21) Appl. No.: 11/910,328

(22) PCT Filed: May 29, 2006

(86) PCT No.: PCT/EP2006/062671

§ 371 (c)(1),
(2), (4) Date: Oct. 1, 2007

(87) PCT Pub. No.: WO2007/009829

PCT Pub. Date: Jan. 25, 2007

(65) Prior Publication Data

US 2008/0184969 A1 Aug. 7, 2008

(30) Foreign Application Priority Data

Jul. 19, 2005 (DE) ..... 10 2005 033 638

(51) Int. Cl.
*F02M 37/00* (2006.01)
*F02M 57/02* (2006.01)

(52) U.S. Cl. ..... 123/446; 123/514

(58) Field of Classification Search ..... 123/446, 123/447, 514
See application file for complete search history.

(56) References Cited

U.S. PATENT DOCUMENTS 3,519,370 A * 7/1970 Bleuel ..... 417/273
3,682,572 A * 8/1972 Yarger ..... 417/273
4,476,836 A * 10/1984 Enomoto et al. ..... 123/502
4,554,903 A * 11/1985 Straubel et al. ..... 123/575
4,709,673 A * 12/1987 Babitzka ..... 123/299
4,767,288 A * 8/1988 Straubel ..... 417/462
5,146,895 A * 9/1992 Fehlmann et al. ..... 123/449
5,701,873 A * 12/1997 Schneider ..... 123/516
5,984,650 A * 11/1999 Okubo et al. ..... 417/470
6,293,253 B1 * 9/2001 Arnold et al. ..... 123/458
6,581,577 B1 * 6/2003 Geyer ..... 123/514
6,694,950 B2 * 2/2004 Djordjevic ..... 123/446
6,722,857 B1 * 4/2004 Kellner et al. ..... 417/255
6,748,923 B2 * 6/2004 Grossner et al. ..... 123/446
6,755,625 B2 * 6/2004 Breeden ..... 417/298
6,772,734 B2 * 8/2004 Schueler ..... 123/446
6,817,841 B2 * 11/2004 Frank et al. ..... 417/273

(Continued)

FOREIGN PATENT DOCUMENTS

EP 1 262 658 A2 12/2002

(Continued)

*Primary Examiner*—Thomas N Moulis
(74) *Attorney, Agent, or Firm*—Ronald E. Greigg

(57) ABSTRACT

A fuel supply system comprises a piston pump having a working chamber and an adjustable throttle device, arranged upstream of the working chamber and adapted to modify the flow of fuel supplied to the working chamber. The invention is characterized in that the throttle device, in the closed position, allows a leakage volume to arrive at the working chamber. The piston pump comprises a leakage pump device which supplies at least a part of the leakage volume from the working chamber to a low-pressure zone located upstream of the throttle device.

20 Claims, 5 Drawing Sheets

U.S. PATENT DOCUMENTS

| | | | | |
|---|---|---|---|---|
| 6,959,694 | B2 * | 11/2005 | Kieferle et al. | 123/446 |
| 7,059,302 | B2 * | 6/2006 | Lemoure | 123/446 |
| 7,077,107 | B2 * | 7/2006 | Boos et al. | 123/446 |
| 7,347,186 | B2 * | 3/2008 | Ricco et al. | 123/446 |
| 7,438,057 | B2 * | 10/2008 | Scheurer et al. | 123/514 |
| 2002/0034448 | A1 * | 3/2002 | De Matthaeis | 417/295 |
| 2002/0189436 | A1 * | 12/2002 | Frank et al. | 92/61 |
| 2002/0189589 | A1 | 12/2002 | Kato et al. | |
| 2003/0154959 | A1 | 8/2003 | Rembold et al. | |
| 2003/0192509 | A1 | 10/2003 | Ishimoto | |
| 2005/0103313 | A1 | 5/2005 | Lemoure | |
| 2008/0245904 | A1 * | 10/2008 | Harcombe et al. | 239/569 |

FOREIGN PATENT DOCUMENTS

| | | | |
|---|---|---|---|
| WO | WO 02/063158 | A1 | 8/2002 |
| WO | WO 2004/036034 | A1 | 4/2004 |

* cited by examiner

FUEL SUPPLY SYSTEM, ESPECIALLY FOR AN INTERNAL COMBUSTION ENGINE

CROSS-REFERENCE TO RELATED APPLICATION

This application is a 35 USC 371 application of PCT/EP 2006/062671 filed on May 29, 2006.

BACKGROUND OF THE INVENTION

1. Field of the Invention

The invention relates to an improved fuel supply system for an internal combustion engine.

2. Description of the Prior Art

German Patent Disclosure DE 102 20 281 A1 describes a fuel system for an internal combustion engine, in which fuel is pumped from a prefeed pump to a high-pressure pump and from there into a high-pressure fuel rail. A plurality of injectors are connected to this rail and inject the fuel directly into combustion chambers of the engine. The feed quantity of the high-pressure pump that is mechanically driven by the engine is determined by an upstream throttle device. To limit the production costs, the throttle device is designed such that even in the completely closed state, it allows a certain leakage quantity of fuel to pass through. This quantity is returned to a low-pressure region via a zero-feed line, in which there is a zero-feed throttle restriction, and thus does not reach the actual piston pump.

SUMMARY AND ADVANTAGES OF THE INVENTION

The present invention has the object of refining a fuel supply system of the type defined above in such a way that its construction is as simple as possible.

In the fuel supply system of the invention, it is expressly permitted that the leakage quantity allowed through by the throttle device reaches the work chamber of the piston pump. Thus the zero-feed line and a zero-feed throttle restriction located in it that were previously required can be dispensed with, which simplifies the construction of the fuel supply system of the invention considerably. This also reduces costs.

In order nevertheless to assure that, for instance in the overrunning mode of an engine for which the fuel supply system is intended, no fuel will be pumped by the piston pump, according to the invention a special leakage pump device is provided, by which the leakage quantity is at least in part pumped away from the work chamber to a low-pressure region located upstream of the throttle device. The low-pressure region may for instance be directly upstream of an inlet valve of the piston pump, so that the fuel supply system is very compact, and additional long lines are unnecessary.

If the return of the leakage quantity discharges upstream of a filter, then abrasion generated in piston pump operation is reliably kept away from the piston pump, the throttle device, and other valve devices, which improves the service life and the reliability of the fuel supply system of the invention.

Especially simply and with little additional expense, the leakage pump device can be implemented by the pump piston of the piston pump itself and by the guide gap between the pump piston and the pump housing. A leakage quantity reaching the work chamber is in this case carried away simply by the pressure difference between the work chamber and the drive side of the pump piston. Good efficiency of the fuel supply system is maintained, if the guide gap is embodied such that, with the throttle device closed, precisely only the leakage quantity of the throttle device is pumped back to the low-pressure region.

Typically, the fuel supply system pumps into a high-pressure chamber, for instance a high-pressure rail. To enable reducing the pressure in this high-pressure chamber in certain operating situations in a simple way, the high-pressure chamber may communicate with the work chamber of the piston pump via a throttle restriction that is fluidically parallel to an outlet valve of the piston pump. In this way, a separate pressure relief valve on the high-pressure chamber can be dispensed with, which further simplifies the construction and reduces the corresponding costs of the fuel supply system of the invention.

For reliable operation of the fuel supply system of the invention, it is appropriate if the differential opening pressure of an inlet valve of the piston pump amounts to at least approximately 1 bar, since in that case the formation of fuel vapor from pressure pulsations in piston pump operation between the throttle device and the inlet valve is prevented.

Overall, the leakage quantity is kept low if, in the case of a throttle device with a throttle slide, a control opening is present not on the throttle slide but rather on the throttle housing. The guide gap between the throttle slide and throttle housing should be smaller than or equal to the guide gap between the pump piston and the pump housing. Typical values are 4 and 7 μm, respectively.

To avoid an unnecessary pressure buildup in the high-pressure chamber, the leakage quantity of the throttle device should be less than the fuel demand of an idling engine, that is, when only a minimal fuel quantity is being injected into the combustion chambers of the engine.

BRIEF DESCRIPTION OF THE DRAWINGS

Especially preferred exemplary embodiments of the present invention will be described in further detail below in conjunction with the accompanying drawings. In the drawings.

DESCRIPTION OF THE PREFERRED EMBODIMENTS

Figure 1:
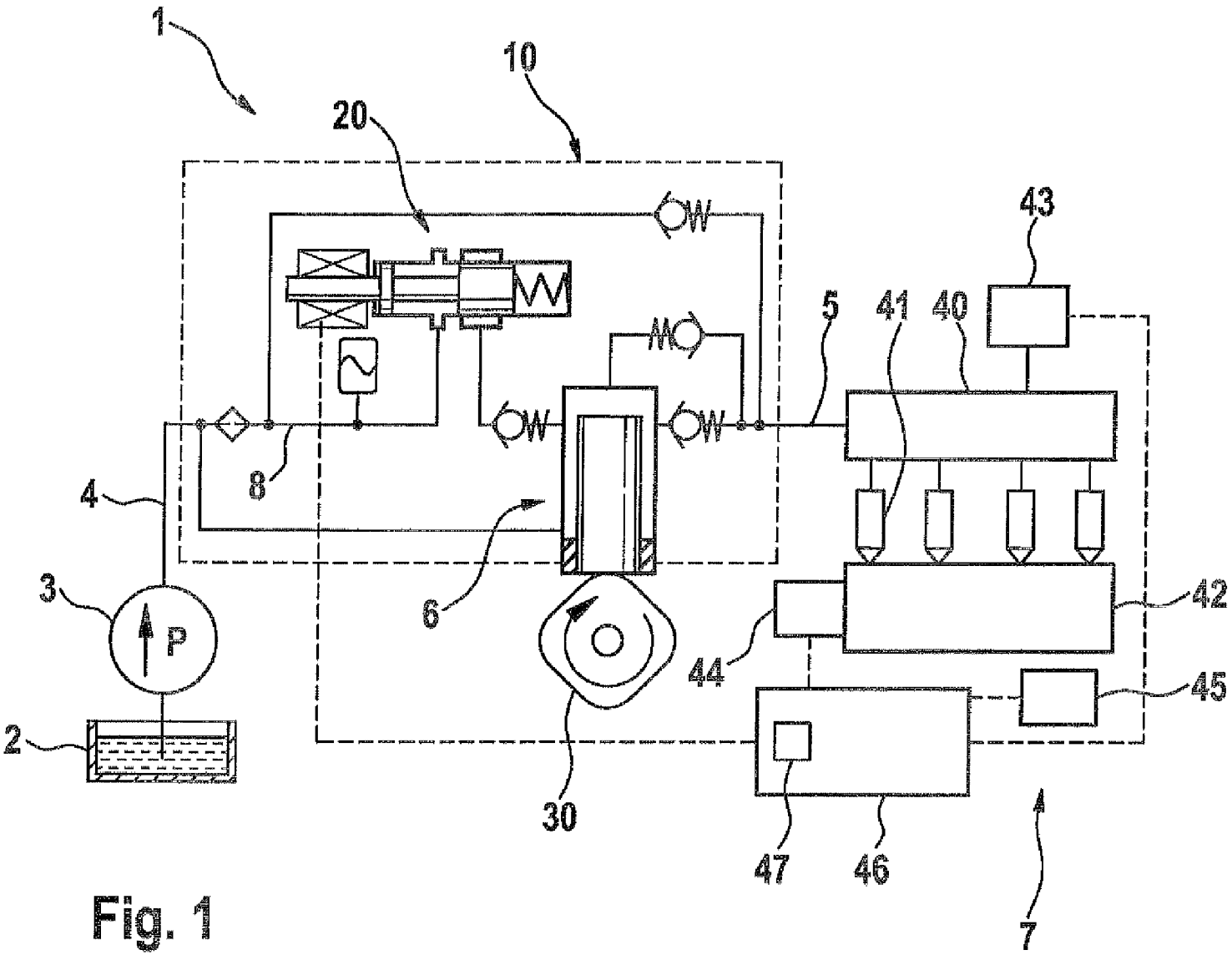
FIG. 1 is a schematic illustration of a first exemplary embodiment of a fuel supply system and an internal combustion engine.

A first embodiment of a fuel supply system is identified overall in FIG. 1 by reference numeral 1. It includes a fuel tank 2, from which a prefeed pump 3 pumps the fuel via a line 4 to a high-pressure pump unit 10. This high-pressure pump unit includes a throttle device 20 and a high-pressure piston pump 6. The throttle device 20 is located fluidically between the prefeed pump 3 and the high-pressure piston pump 6, and on the low-pressure region it regulates the pumping quantity of the high-pressure piston pump 6. This piston pump, in the present exemplary embodiment, is driven via a cam 30, which in turn is driven mechanically, in a manner not shown in detail in FIG. 1 by an internal combustion engine 7, for instance by its camshaft or crankshaft. The cam 30 may also be part of the camshaft or crankshaft.

The high-pressure piston pump 6 compresses the fuel delivered to it to a comparatively high pressure and pumps it via a line 5 into a high-pressure chamber 40. In it, the fuel is stored at high pressure; it is also known as a "high-pressure reservoir" or "rail". A plurality of injectors 41 are connected to the high-pressure chamber 40 and inject the fuel directly into combustion chambers 42 associated with each of them.

The pressure prevailing in the high-pressure chamber 40 is detected by a pressure sensor 43. The rpm of a crankshaft, not shown, of the engine 7 is detected by an rpm transducer 44, and a temperature of the engine 7 is detected via a temperature sensor 45. A control and regulating unit 46 controls or regulates, among other things, the operation of the throttle device 20; the signals of the sensors 43, 44 and 45, and optionally still other sensors, enter into the control or regulation as applicable. A computer program for triggering the throttle device is stored in memory on a memory medium 47 of the control and regulating unit 46.

Figure 2:
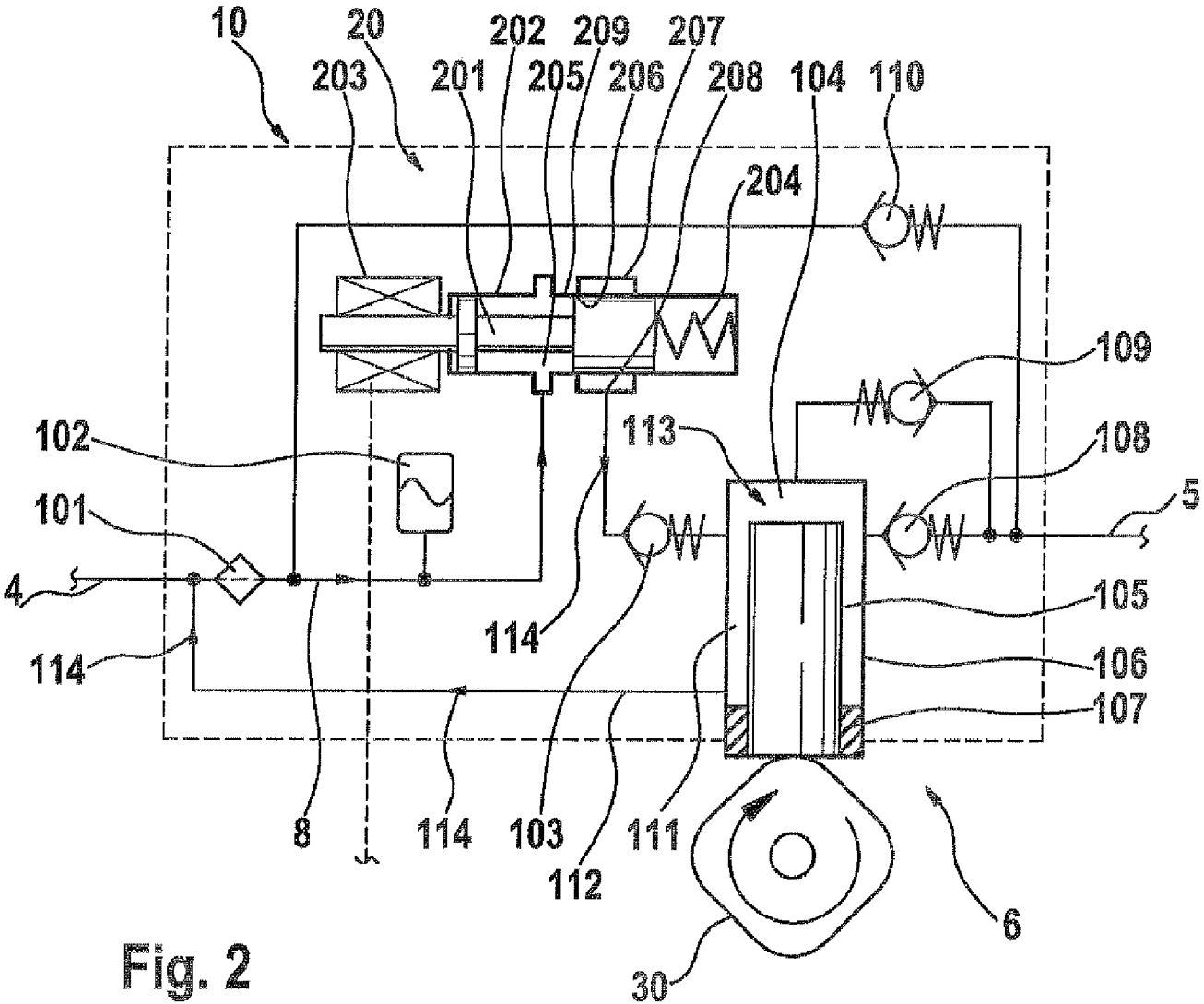
FIG. 2 is an enlarged view of a region of the fuel supply system of FIG. 1.

FIG. 2 will now be described, in which the high-pressure pump unit 10 is shown enlarged. Upstream of the throttle device 20 in the high-pressure pump unit 10, there is a filter 101, and in a conduit 8 that is part of the low-pressure region, there is a pressure damper 102. The latter is intended to damp pulsations of the high-pressure piston pump 6, for instance in the line 4. It is also intended to assure a high degree of delivery of the high-pressure piston pump 6, even at high rpms and high numbers of cams.

The throttle device 20 includes a cylindrical throttle slide 201 and a cylindrical throttle housing 202. The throttle slide 201 is actuated by an electromagnetic actuator 203, against which the throttle slide 201 is urged by a compression spring 204. The throttle slide 201 has a portion of lesser diameter (not identified by reference numeral), by which an inlet chamber 205 is formed between the throttle slide 201 and the throttle housing 202. On the throttle slide 201, there is an encompassing control edge 206, which cooperates with control openings 207 embodied on the throttle housing 202. Via a connection 208, these control openings lead to the high-pressure piston pump 6. Between the throttle slide 201 and the throttle housing 202, there is a guide gap 209.

The high-pressure piston pump 6 in turn includes an inlet valve 103, by way of which the fuel from the connection 208 of the throttle device 20 can reach a work chamber 104 that is formed between a pump piston 105 and a pump housing 106. The pump piston 105 is sealed off from the work chamber, in which the cam 30 is located, via a piston seal 107. From the work chamber 104, the fuel reaches the high-pressure chamber 40 via an outlet valve 108. Parallel to it but with an opposite opening direction, a pressure limiting valve 109 is disposed between the work chamber 104 and the high-pressure chamber 40. In normal operation of the fuel supply system 1, this valve is closed.

Fluidically parallel to the throttle device 20 and to the high-pressure piston pump 6, a bypass valve 110 is also disposed in the high-pressure pump unit 10; it connects the high-pressure chamber 40 with the conduit 8 located between the filter 101 and the pressure damper 102, and it opens toward the high-pressure chamber 40. This bypass valve 110 is likewise closed in normal operation. In the event of a malfunction, for instance if the throttle device 20 sticks in the closed position, however, fuel can reach the high-pressure chamber 40 via this bypass valve 110, so that in the high-pressure chamber, at least the pressure generated by the prefeed pump 3 prevails, which makes a certain emergency operation of the engine 7 possible.

Between the pump piston 105 and the pump housing 106, there is a guide gap 111. Directly upstream of the piston seal 107, a leak fuel line 112 branches off from the guide gap 111; this line leads to the low-pressure region 8 directly upstream of the filter 101. The orifice of the leak fuel line 112 is accordingly covered by the pump piston 105, while conversely the orifices of the pump piston 105 coming from the inlet valve 103 into the work chamber 104 and from the work chamber 104 to the outlet valve 108, are always open.

In normal operation, the prefeed pump 3 generates a prefeed pressure at the level of approximately 6 bar. Depending on the position of the throttle slide 201 of the throttle device 20, and depending on the corresponding overlap of the control edge 206 and the control openings 207, more or less fuel reaches the high-pressure piston pump 6. During the intake phase, the fuel is aspirated into the work chamber 104 via the inlet valve 103. Depending on the throttling, more or less vapor is then created in the work chamber 104. In this way, the pumping quantity of the high-pressure piston pump 6 to the high-pressure chamber 40 is adjusted. It should be pointed out that in the present exemplary embodiment, the throttle device 20 is "closed when without current", which means that the throttle slide 201 is pressed by the compression spring 204 into the closed position when the electromagnetic actuator 203 is without current. To avoid the creation of fuel vapor between the connection 208 and the inlet valve 103, the differential opening pressure of the inlet valve is approximately 1 bar. If diesel fuel, which has a different vapor pressure, is used, then the differential opening pressure can also be markedly less.

Even in the closed position of the throttle device 20, however, fuel can pass through the guide gap 209 between the throttle slide 201 and the throttle housing 202 and via the inlet valve 103 reach the work chamber 104 of the high-pressure piston pump 6. In order nevertheless to prevent the pressure in the work chamber 104 from reaching a level at which the outlet valve 108 opens and fuel gets into the high-pressure chamber 40, this fuel quantity, also called the "leakage quantity", is pumped out of the work chamber 104 via a leakage pump device 113 from the work chamber 104.

This leakage pump device 113, in the present exemplary embodiment, is formed simply by the pump piston 105 and the guide gap 111 between the pump piston 105 and the pump housing 106. This gap is specifically dimensioned such that, because of the pressure difference between the work chamber 104 and the prefeed pressure prevailing directly upstream of the piston seal 107, in a pumping stroke of the pump piston 105 precisely the leakage quantity that reaches the work chamber 104 when the throttle device 20 is closed is pumped away via the leak fuel line 112. Functionally, the "zero-feed throttle restriction" that was previously usual is thus formed by the guide gap 111.

In this way, zero feeding of the high-pressure piston pump 6 can reliably be attained. Zero feeding is wanted for instance whenever the engine 7, which serves to drive a motor vehicle, is in an overrunning mode, in which while the cam 30 is driven, still no fuel reaches the combustion chambers 42 via the injectors 41. In such a case, to avoid an unwanted pressure increase in the high-pressure chamber 40, and to enable dispensing with a separate pressure relief device, it must be assured that the pumping of fuel by the high-pressure piston pump 6 can be suppressed entirely. Thanks to the leakage pump device 113 provided, this is possible even with a throttle device 20 that does not close completely in the closed state.

For this purpose, it is necessary to adapt the guide gap 209 of the throttle device 20 and the guide gap 111 of the high-pressure piston pump 6 to one another in such a way that the leakage quantity allowed through by the throttle device 20 is pumped back, by means of the pumping motion of the pump piston 105, past the guide gap 111 without the opening pressure of the outlet valve 108 in the work chamber 104 being reached, at a very specific pressure in the high-pressure chamber 40. This very specific pressure in the high-pressure chamber 40 may for instance be a pressure at which the injectors 41 can still reliably inject the fuel into the combustion chambers 42. In FIG. 2, the course of the leakage flow is illustrated by arrows 114.

Figure 3:
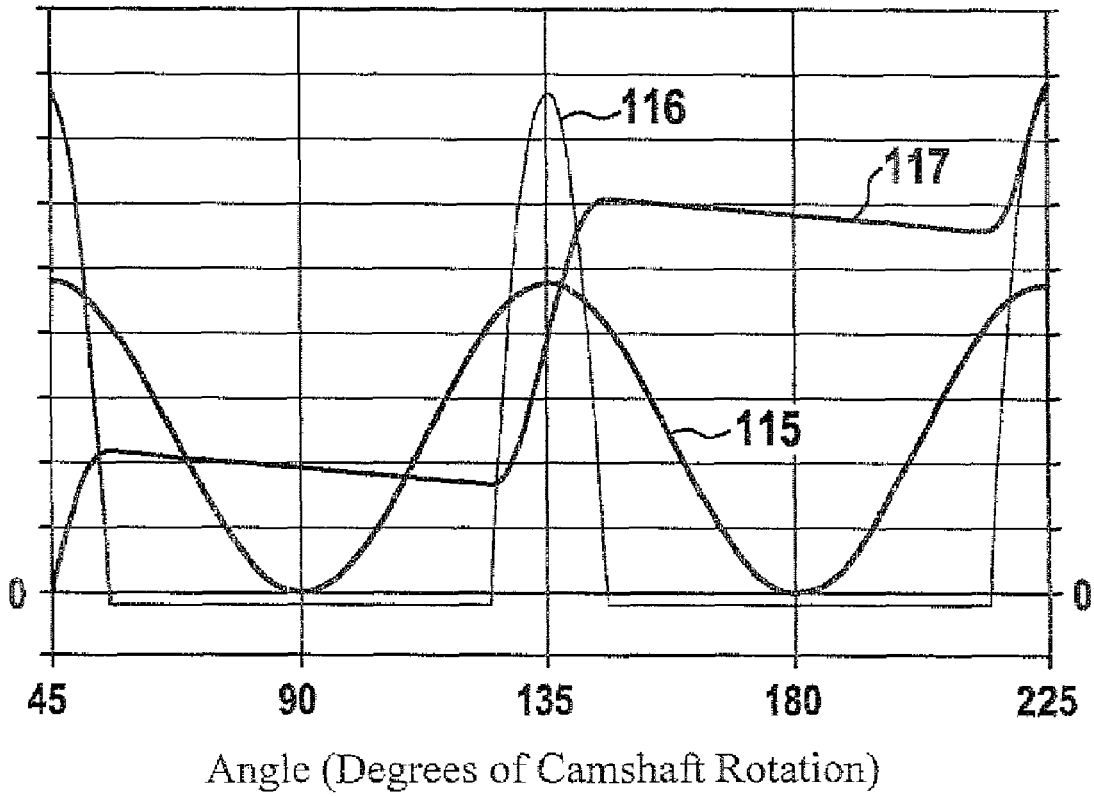
FIG. 3 is a graph in which a pressure difference via a pump piston of the supply system of FIG. 1, a piston stroke, and a leakage quantity of a throttle device are plotted over the angle of a driveshaft.

The functional principle of the leakage pump device 113 is also shown by the graph in FIG. 3. It can be seen that in the region of top dead center of the pump piston 105 (the stroke of the pump piston 105 is represented by the curve 115), a "pressure crest" (curve 116) is embodied in the work chamber 104. Zero feeding of the high-pressure piston pump 6 exists whenever the maximum pressure of this pressure crest is at most equal to the current pressure in the high-pressure chamber 40. That is assured only whenever the entire leakage quantity that is allowed to pass by the throttle device 20 is carried away by the leakage pump device 113. Otherwise, the pressure in the work chamber 104 would increase in each work cycle of the high-pressure piston pump 6, until finally the outlet valve 108 would close.

The leakage quantity carried away by the leakage pump device 113 via the guide gap 111 is represented by the curve 117. It can be seen that at the high pressure prevailing in the region of top dead center, a relatively large leakage quantity passes through the guide gap 111 and is carried away by the leak fuel line 112. Outside top dead center of the pump piston 105, however, a lower pressure than in the conduit or low-pressure region 8 prevails in the work chamber 104, so that a certain fuel quantity, although very slight, flows back into the work chamber 104 via the guide gap 111. In a typical adaptation, the guide gap 111 has a value of 7 μm, while conversely the guide gap 209 has a value of 4 μm.

In order also to be able to attain operating states of the engine 7 in which a reduced pressure is desired in the high-pressure chamber 40, for instance in idling, the leakage quantity of the throttle device 20 should be less than the fuel demand of the engine 7 while it is idling. This is associated with the fact that at such a low pressure in the high-pressure chamber 40, the outlet valve 108 already opens even at a correspondingly low pressure, so that the maximum pressure in the work chamber 104 likewise corresponds at most to the reduced pressure in the high-pressure chamber 40. At this kind of reduced pressure, however, the pressure past the guide gap 111 also drops, which reduces the "pumping output" of the leakage pump device 113. Optionally, because of this reduction in the pressure difference past the guide gap 111, it would even be possible for the entire leakage quantity that is allowed through by the throttle device 20 to be pumped by the high-pressure piston pump 6 to the high-pressure chamber 40. Therefore, as noted, this leakage quantity should at most correspond to the fuel demand of the engine 7 while idling.

The pressure in the high-pressure chamber 40 can be reduced by providing that more fuel is injected by the injectors 41 into the combustion chambers 42 than is pumped by the fuel supply system 1 into the high-pressure chamber 40. This can be regulated by means of the throttle device 20. It is understood that the maximum pressure in the high-pressure chamber 40 that is established in the overrunning mode of the engine 7 should in principle be no greater than a pressure at which the injectors 41 still function reliably. If such a reduction in the pressure in the high-pressure chamber 40 is not possible, then this must be compensated for by a suitably altered triggering of the injectors 41.

In the event of error, for instance if the throttle device 20 sticks in the open state, the pressure in the high-pressure chamber 40 is limited to a defined maximum value by the pressure limiting valve 109.

It will furthermore be pointed out that in the above-described, especially advantageous exemplary embodiment, the guide gap 111 functions as a flow throttle restriction between the work chamber 104 and the leak fuel line 112. However, it is conceivable, although not shown, that the leak fuel line branch off directly from the work chamber 104 and that a separate flow throttle restriction be present in it that takes on the hydraulic function of the guide gap 111. However, if the guide gap 111 functions as a flow throttle restriction, then this has the advantage that a variable throttling action can be attained, which is at its least at bottom dead center of the pump piston 105 and at its greatest at top dead center.

Figure 4:
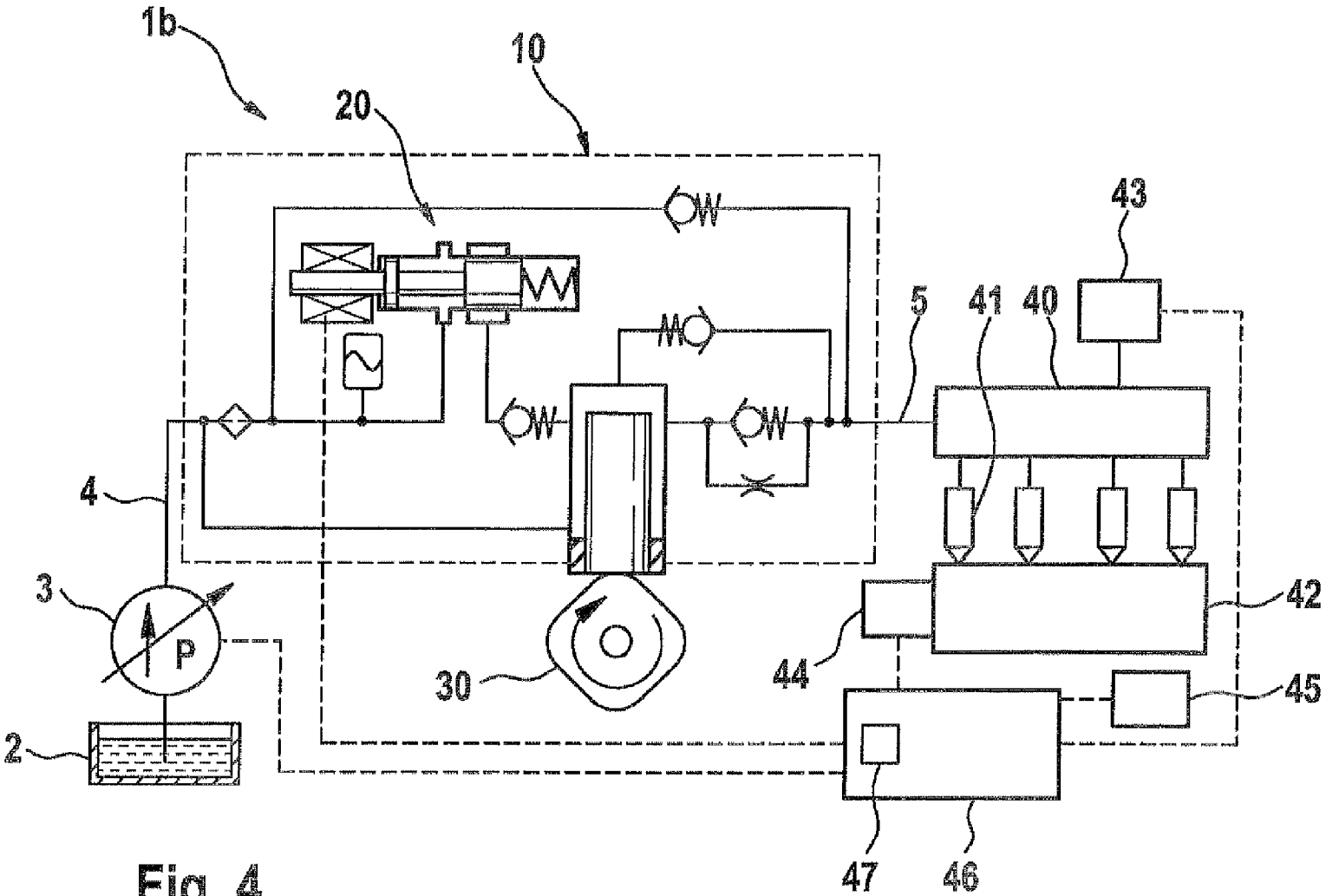
FIG. 4 is a view similar to FIG. 1 of an alternative embodiment of a fuel supply system.
Figure 5:
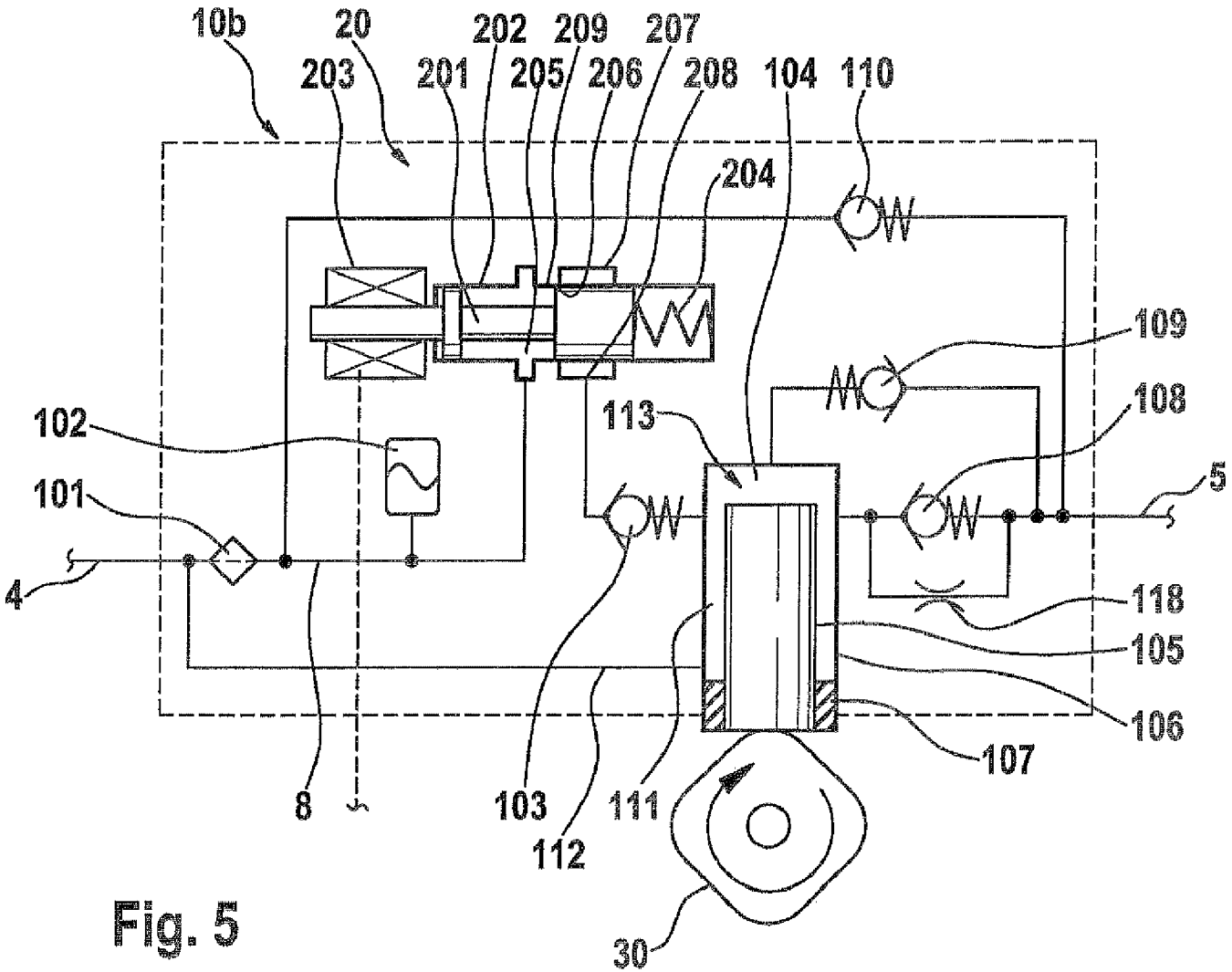
FIG. 5 is an enlarged view of a region of the fuel supply system of FIG. 4.

An alternative embodiment of a fuel supply system 1 is shown in FIGS. 4 and 5. In these drawings, those elements and regions that have equivalent functions to elements and regions of the exemplary embodiment described in conjunction with FIGS. 1 through 3 are identified by the same reference numerals. They will not be described again in detail.

In the fuel supply system 1 shown in FIGS. 4 and 5, the pumping output of the prefeed pump 3 is adjustable. In this way, the pressure in the line 4 and in the low-pressure region 8 can be adjusted to suit a desired pilot pressure. For this purpose, the prefeed pump 3 is triggered by the control and regulating unit 46. This has the advantage first that the prefeed pump 3 is always operated with the least possible output. Second, an adjustable pilot pressure has the advantage that the regulation sensitivity of the throttle device 20 is improved. The pressure difference at the throttle device 20 can be adjusted optimally as a function of the load and rpm of the engine 7, given an adjustable pilot pressure. An increased fuel temperature and an increased vapor pressure can furthermore be compensated for.

A variable pilot pressure can, however, also be utilized in order to control or regulate the leakage quantity of the throttle device 20 and thus a high pressure that comes to be established in the high-pressure chamber 40. For instance, if in the overrunning mode of the engine 7 the pilot pressure is lowered, then the leakage quantity of the throttle device 20 decreases as well, since the pressure difference at the guide gap 209 decreases to the same extent. With a small leakage quantity at the guide gap 209 of the throttle device 20, a likewise lower pressure is established in the high-pressure chamber 40 in the overrunning mode of the engine 7. Conversely, this means that given an adjustable pilot pressure, the demands of the throttle device 20 with regard to regulation sensitivity and the allowable leakage quantity can be lessened. For instance, the guide gap 209 can be enlarged, thus simplifying production.

A further difference between the exemplary embodiment of a fuel supply system 1 shown in FIGS. 4 and 5 and the exemplary embodiment preceding is that a flow throttle restriction 118 is disposed parallel to the outlet valve 108. By means of this throttle restriction, a "passive" pressure reduction in the high-pressure chamber 40 is made possible. In the overrunning mode of the engine 7 or when the engine 7 has been shut off the pressure in the high-pressure chamber 40 can be reduced in this way down to the pressure prevailing in the low-pressure region 8, via the flow throttle restriction 118 and the guide gap 111 of the high-pressure piston pump 6. Particularly in the overrunning mode of the engine 7, the pressure in the high-pressure chamber 40 can thus be lowered to a desired value and regulated, by means of the variable pilot pressure, in such a way that it is ideal for the resumption of injection by the injectors 41.

If in the overrunning mode of the engine 7, an inconsistent aspiration of the leakage quantity admitted by the throttle device 20 should occur because the vapor pressure between the connection 208 and the inlet valve 103 has been undershot, then a stepwise increase, threatened as a result, in the pressure prevailing in the high-pressure chamber 40 is avoided by means of the throttle restriction 118.

In an exemplary embodiment not shown, the fuel supply system includes a high-pressure piston pump with a plurality of pump pistons and work chambers connected fluidically parallel to one another. In this case as well, the metering of the fuel can be effected via a throttle device. In designing the guide gaps, however, the guide gaps of all the pump pistons must be taken into account.

The foregoing relates to a preferred exemplary embodiment of the invention, it being understood that other variants and embodiments thereof are possible within the spirit and scope of the invention, the latter being defined by the appended claims.

The invention claimed is:

1. In a fuel supply system for an internal combustion engine, the system comprising a piston pump with a work chamber, and an adjustable throttle device disposed upstream of the work chamber and which can vary the inflow of fuel to the work chamber, the improvement wherein the throttle device, in the closed state, allows a leakage quantity to reach the work chamber; and piston pump includes a leakage pump device which pumps the leakage quantity at least in part out of the work chamber to a low-pressure region located upstream of the throttle device.

2. The fuel supply system as defined by claim 1, wherein the leakage pump device comprises a pump piston of the piston pump and a throttle conduit that connects the work chamber to the low-pressure region.

3. The fuel supply system as defined by claim 2, wherein the throttle conduit is formed by a guide gap between the pump piston and a pump housing.

4. The fuel supply system as defined by claim 3, wherein the guide gap is embodied such that when the throttle device is closed, precisely the leakage quantity of the throttle device is pumped back to the low-pressure region.

5. The fuel supply system as defined by claim 1, further comprising a high-pressure chamber, into which the piston pump pumps via an outlet valve, communicates with the work chamber of the piston pump via a throttle restriction that is fluidically parallel to the outlet valve.

6. The fuel supply system as defined by claim 2, further comprising a high-pressure chamber, into which the piston pump pumps via an outlet valve, communicates with the work chamber of the piston pump via a throttle restriction that is fluidically parallel to the outlet valve.

7. The fuel supply system as defined by claim 3, further comprising a high-pressure chamber, into which the piston pump pumps via an outlet valve, communicates with the work chamber of the piston pump via a throttle restriction that is fluidically parallel to the outlet valve.

8. The fuel supply system as defined by claim 4, further comprising a high-pressure chamber, into which the piston pump pumps via an outlet valve, communicates with the work chamber of the piston pump via a throttle restriction that is fluidically parallel to the outlet valve.

9. The fuel supply system as defined claim 1, further comprising an inlet valve disposed fluidically between the throttle device and the work chamber, and wherein the differential opening pressure of the inlet valve amounts to approximately 1 bar.

10. The fuel supply system as defined claim 2, further comprising an inlet valve disposed fluidically between the throttle device and the work chamber, and wherein the differential opening pressure of the inlet valve amounts to approximately 1 bar.

11. The fuel supply system as defined claim 3, further comprising an inlet valve disposed fluidically between the throttle device and the work chamber, and wherein the differential opening pressure of the inlet valve amounts to approximately 1 bar.

12. The fuel supply system as defined claim 4, further comprising an inlet valve disposed fluidically between the throttle device and the work chamber, and wherein the differential opening pressure of the inlet valve amounts to approximately 1 bar.

13. The fuel supply system as defined claim 5, further comprising an inlet valve disposed fluidically between the throttle device and the work chamber, and wherein the differential opening pressure of the inlet valve amounts to approximately 1 bar.

14. The fuel supply system as defined by claim 1, wherein the throttle device includes a throttle slide guided in a throttle housing; and at least one control opening of the throttle device in the throttle housing.

15. The fuel supply system as defined by claim 2, wherein the throttle device includes a throttle slide guided in a throttle housing; and at least one control opening of the throttle device in the throttle housing.

16. The fuel supply system as defined by claim 3, wherein the throttle device includes a throttle slide guided in a throttle housing, the throttle housing having at least one control opening of the throttle device, and wherein a guide gap between the throttle slide and the throttle housing is smaller than or equal in size to the guide gap between the pump piston and the pump housing.

17. The fuel supply system as defined by claim 16, wherein the guide gap between the throttle slide the throttle housing is approximately 4 μm wide, and the guide gap between the pump piston and the pump housing is approximately 7 μm wide.

18. The fuel supply system as defined by claim 1, wherein the leakage quantity is less than the fuel demand of the idling engine that is supplied at least indirectly by the fuel supply system.

19. The fuel supply system as defined by claim 1, further comprising a filter, the leakage quantity being pumped into a region located upstream of the filter.

20. The fuel supply system as defined by claim 1, wherein the piston pump includes a plurality of fluidically parallel pump pistons and work chambers.

* * * * *